US009899199B2

(12) United States Patent
Mavanur et al.

(10) Patent No.: US 9,899,199 B2
(45) Date of Patent: Feb. 20, 2018

(54) MASS SPECTROMETER COMPRISING A RADIO FREQUENCY ION GUIDE HAVING CONTINUOUS ELECTRODES

(71) Applicant: Bruker Daltonics, Inc., Billerica, MA (US)

(72) Inventors: Anil Mavanur, Littleton, MA (US); Jens Bossmeyer, Bremen (DE); Chaminda M. Gamage, North Andover, MA (US); Felician Muntean, Andover, MA (US)

( * ) Notice: Subject to any disclaimer, the term of this patent is extended or adjusted under 35 U.S.C. 154(b) by 0 days.

(21) Appl. No.: 15/197,868

(22) Filed: Jun. 30, 2016

(65) Prior Publication Data

US 2018/0005812 A1 Jan. 4, 2018

(51) Int. Cl.

| | |
|---|---|
| ***H01J 49/26*** | (2006.01) |
| ***H01J 49/06*** | (2006.01) |
| ***H01J 49/42*** | (2006.01) |
| ***H01J 49/00*** | (2006.01) |
| ***H01J 49/24*** | (2006.01) |

(52) U.S. Cl.

CPC ..... *H01J 49/063* (2013.01); *H01J 49/005* (2013.01); *H01J 49/24* (2013.01); *H01J 49/4205* (2013.01)

(58) Field of Classification Search

CPC ..... H01J 49/06; H01J 49/062; H01J 49/063; H01J 49/064; H01J 49/066; H01J 49/422

USPC ..... 250/281, 282, 283

See application file for complete search history.

(56) References Cited

U.S. PATENT DOCUMENTS

| | | | |
|---|---|---|---|
| 2,769,910 | A | 11/1956 | Elings |
| 5,572,035 | A | 11/1996 | Franzen |
| 5,652,427 | A | 7/1997 | Whitehouse et al. |
| 6,107,628 | A | 8/2000 | Smith et al. |
| 6,559,444 | B2 | 5/2003 | Franzen |
| 8,124,930 | B2 | 2/2012 | Wang |

(Continued)

FOREIGN PATENT DOCUMENTS

| | | | |
|---|---|---|---|
| JP | 3758382 | B2 | 3/2006 |
| JP | 5297773 | B2 | 9/2013 |

OTHER PUBLICATIONS

Belov et al. Initial Implementation of an Electrodynamic Ion Funnel With Fourier Transform Ion Cyclotron Resonance Mass Spectrometry, American Society for Mass Spectrometry, vol. 11, Issue 1, Jan. 2000.

*Primary Examiner* — Nicole Ippolito
(74) *Attorney, Agent, or Firm* — Benoît & Côté Inc.

(57) ABSTRACT

The invention relates to a mass spectrometer, comprising an ion guide having a plurality of electrodes that are supplied with a radio frequency voltage to facilitate radial confinement of ions in an internal volume defined by inward facing surfaces of the electrodes, the internal volume including a first section having a variable radial diameter along a longitudinal axis of the ion guide, in which the electrodes are helically wound, and an adjacent second section having a substantially constant radial diameter along the longitudinal axis, wherein the electrodes extend from the first section to the second section continuously. The continuous nature of the ion guide electrodes facilitates in particular unhindered axial propagation of ions through the assembly and prevents ion losses during their transmission through different compartments of the mass spectrometer.

20 Claims, 6 Drawing Sheets

(56) References Cited

U.S. PATENT DOCUMENTS

2016/0181080 A1* 6/2016 Williams ..... H01J 49/063
250/292

* cited by examiner

MASS SPECTROMETER COMPRISING A RADIO FREQUENCY ION GUIDE HAVING CONTINUOUS ELECTRODES

BACKGROUND OF THE INVENTION

Field of the Invention

The invention relates to radio frequency (RF) ion guides having continuous electrodes for use in mass spectrometers, such as triple quadrupole mass spectrometers.

Description of the Related Art

With reference to FIG. 1, in its simplest form, a mass spectrometer can be described to comprise an ionizing portion A in which a sample of arbitrary nature is transferred into the gas-phase, if not already gaseous such as an eluent from a gas chromatograph, and ionized. Examples for ionization mechanisms are electrospraying, matrix-assisted laser desorption/ionization, electron ionization, and photoionization, to name but a few.

Downstream from the ionizing portion A, there can be located an ion manipulating, selecting or fragmenting portion B. Manipulation could be effected by mechanisms such as collisional cooling and radial focusing/collimation; selection would be possible with a mass filter or ion trap, for instance; and fragmentation could be brought about by collision induced dissociation, charge transfer induced fragmentation or photo-induced fragmentation, as a skilled practitioner sees fit.

After the manipulating, selecting or fragmenting portion B, there is located an analyzing portion C that may operate according to principles such as time-of-flight, cyclotron resonance, RF driven stability-instability, and the like. In some implementations, the function of the ion manipulating, selecting or fragmenting portion B and that of the analyzing portion C can be combined in one device in the mass spectrometer, sometimes called tandem-in-time approach as compared to the tandem-in-space one as with a triple quadrupole mass analyzer.

A detecting portion D after the analyzing portion C acquires data representative of the ion current under investigation and allows deriving its composition. The detecting portion D may comprise elements such as dynodes and microchannel plates (destructive or consuming type of detection) or pick-up electrodes for image currents (non-destructive or non-consuming type of detection), for example. As all these afore-mentioned portions in a mass spectrometer can be located in different pressure regimes, ion transmission between these portions can be considered to be of major importance for the functioning of the mass spectrometer.

As evident from FIG. 2, an embodiment of a "twisted quadrupole beam transport system" having four helically wound and intertwined electrodes with constant inner diameter along their length is presented in "Quadrupole Mass Spectrometry and Its Applications", edited by Peter H. Dawson, American Institute of Physics, 1995. However, this embodiment is stated to be "static" which means that only DC voltages are supplied to the individual electrodes as a consequence of which dynamic radial confinement has to be achieved by the continuous forward motion of the ions through such transport system.

In contrast to that, the first documented use of a pair of helically wound electrodes that have constant inner diameter along the entire length and are driven by alternating voltages, that is "non-static", is found in U.S. Pat. No. 2,769,910 to Elings, though this device represents an early embodiment of a mass filter.

Jochen Franzen introduced the concept of using an RF driven "double helix" of constant (and also variable) inner diameter as an RF ion guide in U.S. Pat. No. 5,572,035 A, see FIG. 3, the disclosure of which shall be incorporated herein by reference in its entirety. Richard D. Smith and Scott A. Shaffer took on this idea in U.S. Pat. No. 6,107,628 A and applied it to an ion guide of tapering inner diameter, a so called "ion funnel" the radial ion focusing forces of which increase from the wide end to the narrow end and through which ions pass in the same direction resulting in a finely collimated ion beam at the exit, as shown in FIG. 4. Similar disclosures pertain to the mounting of such double helix structure, such as in JP 3758382 B2 and JP 5297773 B.

The idea of employing helically wound electrodes for an RF ion funnel was further expanded in U.S. Pat. No. 6,559,444 B2, likewise to Jochen Franzen, the disclosure of which shall also be incorporated herein by reference in its entirety.

Mingda Wang proposed putting three separate double helix RF ion guides lengthwise in series in U.S. Pat. No. 8,124,930 B2, wherein the pitch between adjacent windings increases along the common axis while the inner diameter remains constant, as shown in FIG. 5. The axial changes in this design lead to axially varying RF fields which are stated to result in a converging ion beam at the (rightmost) exit of the assembly.

Belov et al. (J. Am. Soc. Mass Spectrom., Vol. 11, Issue 1, January 2000, pages 19-23) described an assembly where a stacked plate RF ion funnel, which receives ions from an electrospray probe (ESI) via a capillary, is put in series with a subsequent rod collision cell separated by a vacuum divider, as shown in FIG. 6. Due to the spacing between the exit electrode of the ion funnel and the entrance of the collision cell, the resulting interruption of the confining RF fields there-between and the mismatch of opposing geometric acceptances, a portion of the analyte ions may get lost on its way through the assembly.

Craig M. Whitehouse and Erol Culcicek presented a multipole straight rod ion guide of constant radial diameter that reaches continuously from one vacuum stage into another vacuum stage in U.S. Pat. No. 5,652,427 A.

In view of the foregoing, there is still a need for apparatuses and devices which further exploit the continuous nature of helical conductive coils as electrodes in a multipole RF ion guide for mass spectrometers.

SUMMARY OF THE INVENTION

This disclosure proposes a mass spectrometer, comprising an ion guide with a plurality of electrodes that are supplied with a radio frequency voltage to facilitate radial confinement of ions in an internal volume defined by inward facing surfaces of the electrodes, the internal volume including a first section having a variable radial diameter along a longitudinal axis of the ion guide, in which the electrodes are helically wound, and an adjacent second section having substantially constant radial diameter along the longitudinal axis, wherein the electrodes extend from the first section to the second section continuously.

One advantage of having helically wound electrodes in an ion guide section of variably shaped internal volume, such as a tapering volume or frusto-conical volume, is that, due to the geometric symmetry, the axis of such structure stays free of any RF field perturbation which might adversely affect the axial motion of ions through the ion guide. This stands in contrast to the classical stacked plate or stacked ring ion funnels where variations such as pseudo-potential wells appear on the axis as a result of the spacing and generally discontinuous nature of the RF carrying elements. On the other hand, the latter is necessary to (i) implement the narrowing inner width and hence the funnel shape with discrete elements and (ii) apply alternating RF phases to adjacent elements.

One further consequence of having a plurality of windings of comparatively densely packed helical electrodes is an increased gas conductance through such ion guide (or section thereof). Moreover, since the electrodes are basically of linear constitution (wire-like albeit three-dimensionally formed), they feature a significantly lower electrical capacitance as compared to, for example, the apertured plates which make up the prevalent implementation of RF ion funnels in the prior art. Lower electrical capacitance facilitates faster response to changes in the voltages applied, for instance.

The frequency of the RF voltage for radial ion confinement within the ion guide can typically lie in the range between 1 MHz and 10 MHz. The amplitude may amount to between 50 volts and 1000 volts. The radial diameter in the first section of the ion guide may vary between 30 mm and 1 mm, such as between 15 mm and 5 mm, the wider end having a large geometrical acceptance for receiving a diverging stream of ions and the narrower end emitting an ion beam well collimated around the axis of the ion guide. For a four-electrode ion guide, by way of example, the number of complete windings (full 360° turn) of one electrode per length unit could be on the order of one winding per 10 mm, for instance. In other words, such assembled design would feature four windings, one of the four electrodes each, per 10 mm of ion guide length. The overall axial length of the ion guide, in case of two sections, may typically amount to values such as between 50 mm and 150 mm, wherein a larger part can be taken by the first section of variable radial diameter, such as two thirds of the length so that one third of axial extension of the ion guide remains for the second section having substantially constant radial diameter. Other axial length ratios between the first and second sections, such as unity or even with the second section being longer than the first section, may however also be considered suitable for the application at hand.

A first possible way of producing helical electrodes surrounding a volume of varying diameter along their length would be winding a desired number of malleable strings, such as copper wire having a diameter of 1 mm, for example, around a mandrel the outer surfaces of which would determine the dimensions of the ion guide. Other choices of material may include beryllium copper, phospor bronze, stainless steel, Inconel™, Elgiloy™, or Hastelloy™ some of which provide for superior corrosion resistance. The mandrel, if any is used for the coiling, could have a frusto-conical portion for the first section of the ion guide that transitions into a cylindrical portion having constant outer diameter for the second section of the ion guide.

A second way of producing helical electrodes surrounding a volume of varying diameter along their length could include an extrusion assembly having a number of extrusion nozzles that corresponds to the desired number of electrodes in the ion guide. The material to be extruded preferably has gel-like consistency when exiting the nozzles but cures rapidly thereafter, thereby acquiring the necessary rigidity and conductivity. Translating the extrusion assembly linearly along an axis while rotating it there-about during the extrusion operation would facilitate the production of helically wound structures. This combination of translational and rotational motion results in a body of helically wound electrodes having constant diameter, such as may be used in the second section of the ion guide. Adding a narrowing motion to this in some phases of the process in that the individual nozzles in the assembly are moved gently closer to the common axis (and toward one another) during the simultaneous linear translation and rotation allows the inner width of the helical structures to become gradually narrower, such as may be required for the first section of the ion guide. It goes without saying that stopping the rotational motion of the assembly while maintaining the linear translation would facilitate the production of straight electrode sections, such as may be used in the second section of the ion guide. These examples of how to produce an ion guide having sections with helically wound electrodes is to be understood as non-restrictive. It will be understood by one of skill in the art that he may choose a method that he sees fit for purpose.

The electrodes resulting from the afore-mentioned production techniques can be called seamless as they are produced in one piece without interruption. It would be equally possible, however, to produce the electrodes for the first and second sections separately, such as helically wound for the first and helically wound or substantially straight (or curved but non-helical) for the second, and then bond them to one another (electrically), such as by welding or soldering. This requires that the electrode arrangements at the front faces of the two sections match one another geometrically. Even if not seamless, electrodes thusly bonded still make for a continuous extension from the first to the second section of the ion guide (and any additional adjacent sections, as the case may be). In so doing, the electric confining fields in the internal volume generated by the RF voltages applied to the electrodes are likewise continuous and do not show any axial irregularities.

It is generally conceivable to change a degree of helicity of the helically wound electrodes from the first section to the second section of the ion guide though it may also stay the same.

In various embodiments, the internal volume may taper one of (i) linearly and (ii) non-linearly in the first section of the ion guide. A particular example of a linear taper would be a frusto-conical tapering of the internal volume in the first section of the ion guide. A trumpet-like tapering as an example of a non-linear taper, on the other hand, would facilitate a smoother transition between the two sections, thereby allowing for yet smoother propagation of ions through the ion guide. The latter could also serve to make the total length of the ion guide shorter.

In various embodiments, the constant radial diameter can correspond to one of a (i) largest and (ii) smallest radial diameter in the first section. When the second section of substantially constant radial diameter continues from (or attaches to) the narrow end of the first section, the ions will be collimated into a fine ion beam around the central axis which may be beneficial if the ion beam is bound to be transmitted to a subsequent component in the mass spectrometer that has only limited geometric acceptance, such as through an opening in a vacuum divider wall. On the other hand, it could be useful to widen the ion beam upon transmission to the second section in that the second section continues from (or attaches to) the wide end of the first section. The second section of this latter design could be used, for example, as a reaction chamber where the ions are brought together and intermingled with a reactive species, such as methane for a chemical modification or an ion species of opposite polarity for inducing ion-ion reactions.

In various embodiments, the internal volume may further comprise a third section adjacent to the first or second section having one of a (i) substantially constant and (ii) variable radial diameter along the longitudinal axis, the electrodes extending continuously from the first or second section to the third section, respectively. In so doing, the first and section sections can be connected to an adjacent third section such that the RF confining fields in the internal volume are likewise continuous and do not show any axial irregularities. The concept of having a plurality of sections being connected by continuous electrodes may be expanded, of course, to having four sections, five sections, or any higher number as a skilled practitioner sees fit.

In various embodiments, the mass spectrometer can further comprise first and second vacuum stages separated by a divider wall and held at different pressures, wherein the first and second sections are located substantially in the first and second vacuum stages, respectively, while the electrodes extend continuously through an opening in the divider wall. Preferably, it will be the ion guide section of smallest radial diameter that comes to rest within the opening in the divider wall in order to keep the gas conductance at this interface as low as possible. The continuous nature of the electrodes which transcend the barrier between two different pressure regimes allows ion transmission along the longitudinal axis without any detectable losses. The opening may be worked directly into the wall body or, in a variant, may be located at a cylindrical, tubular member, mounted into the wall, through which the electrodes of the ion guide extend. In contrast to a simple hole in the wall, the cylindrical, tubular member may facilitate yet further decreased gas conductance between the two vacuum stages, thereby reducing the gas load on the respective downstream vacuum stage while maintaining the same orifice size for ion transmission.

In various embodiments, at least one of the plurality of electrodes may comprise an insulator layer on which a resistive coating is deposited, such as being metallized. The resistive coating can be connected to a DC voltage source so as to establish a DC voltage gradient along the longitudinal axis that drives ions through the ion guide. In an optional implementation, the insulator layer and the resistive coating on the electrode(s) extend over one of (i) a portion and (ii) the entire longitudinal dimension of the ion guide. A comparatively low gradient between approximately 0.01 and 1 volts per centimeter ion guide length, preferably about 0.05 or 0.1 V/cm, may be sufficient to drive the ions forward, though values beyond that range are conceivable, too.

Additionally or alternatively, the mass spectrometer may further comprise means for establishing a gas flow through the ion guide as to drive ions through the first and second sections. Other means for driving ions through the ion guide could manifest themselves in auxiliary electrodes located at different longitudinal positions at the radial outer periphery of the ion guide that are supplied with different DC voltages as to establish a longitudinal voltage gradient for that purpose.

In various embodiments, a number of electrodes in the ion guide can be four, six, eight or more and the radio frequency voltage can comprise two phases (0°, 180°) that are applied alternately to adjacent electrodes. In a rather unusual but likewise feasible alternative, a number of electrodes in the ion guide can be three and the radio frequency voltage may then comprise three phases (0°, 120°, 240°) that are applied alternately to adjacent electrodes. Having more than two helical electrodes in the ion guide leads to more comprehensive radial RF confining fields in the internal volume of the ion guide so that an ion beam collimation function of the ion guide is reliably ensured.

In various embodiments, a portion of the second section may extend through a casing in which an elevated gas pressure is maintained so as to function as a collision cell. Inert collision gases such as Helium (He), Argon (Ar), and molecular Nitrogen ($N_2$), are particularly suitable for this purpose.

In various embodiments, the mass spectrometer can further comprise mounting rings to which the electrodes are attached in order to maintain their alignment and positioning. Such mounting means do not only facilitate stable positioning of the individual electrodes toward one another but also allow reliable positioning of the whole electrode assembly in relation to other components in the mass spectrometer.

In various embodiments, the electrodes may take the shape of flat strips a large surface side of which faces the internal volume of the ion guide, thereby increasing the electric field defining surfaces of the electrodes.

In further embodiments, the longitudinal axis of the ion guide may be one of (i) straight or linear and (ii) curved or non-linear, such as bent, the latter particularly in the second section of the ion guide when implemented with a non-helical (or rod-like) electrode configuration.

BRIEF DESCRIPTION OF THE DRAWINGS

The invention can be better understood by referring to the following figures. The elements in the figures are not necessarily to scale, emphasis instead being placed upon illustrating the principles of the invention (often schematically).

DETAILED DESCRIPTION

While the invention has been shown and described with reference to a number of different embodiments thereof, it will be recognized by those skilled in the art that various changes in form and detail may be made herein without departing from the scope of the invention as defined by the appended claims.

Figure 1:
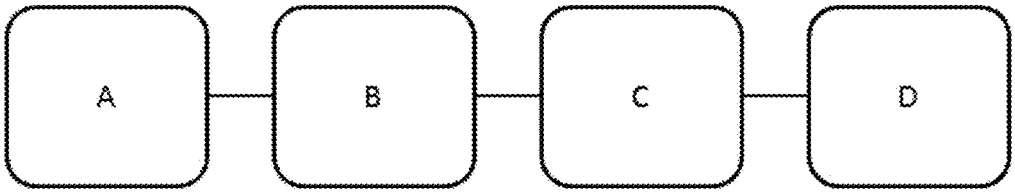
FIG. 1 schematically depicts a basic mass spectrometer arrangement.
Figure 2:
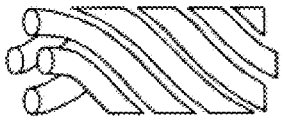
FIGURE 2 (PRIOR ART)
FIGS. 2 to 6 present different prior art ion guide arrangements as set out in the introduction.
Figure 3:
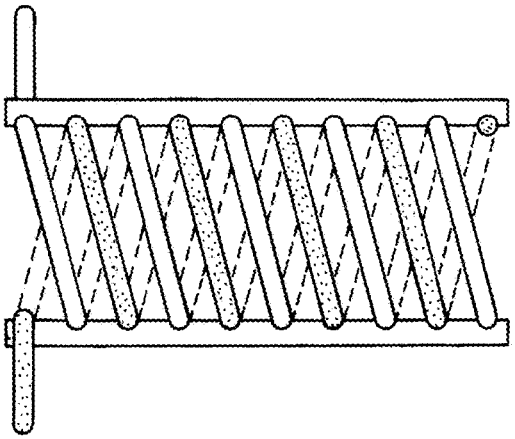
FIGURE 3 (PRIOR ART)
Figure 4:
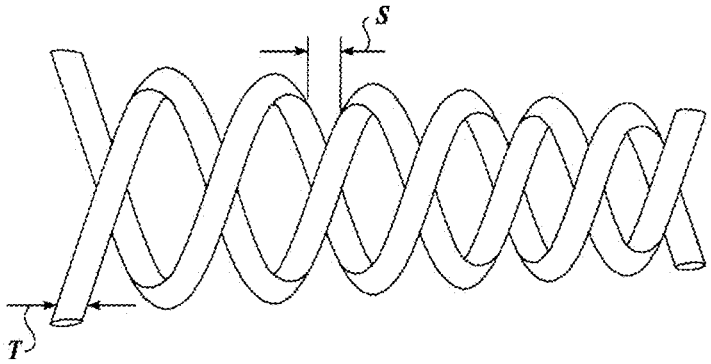
FIGURE 4 (PRIOR ART)
Figure 5:
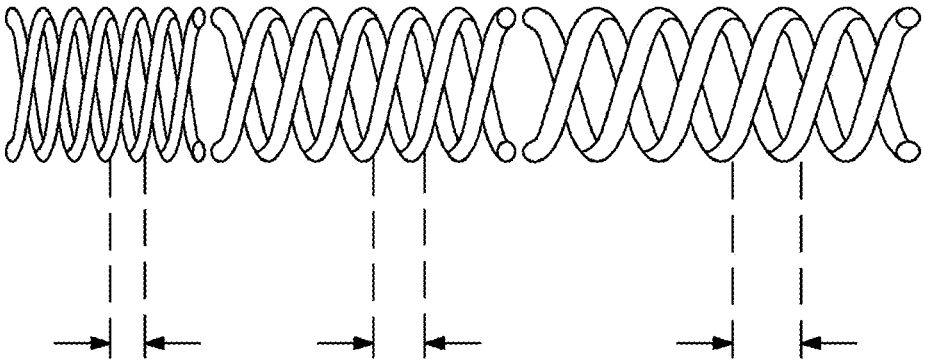
FIGURE 5 (PRIOR ART)
Figure 6:
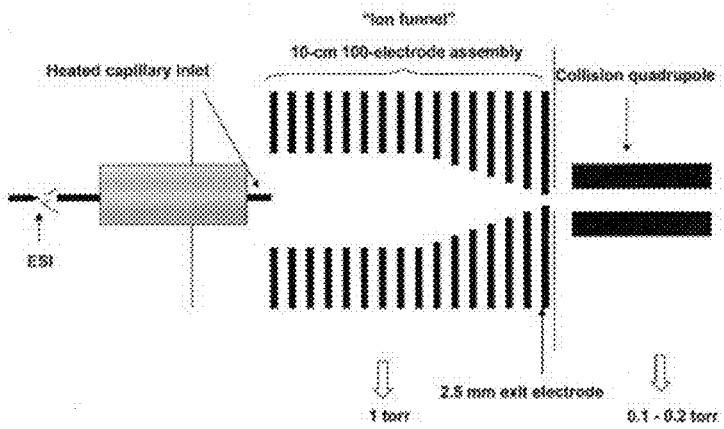
FIGURE 6 (PRIOR ART)
Figure 7:
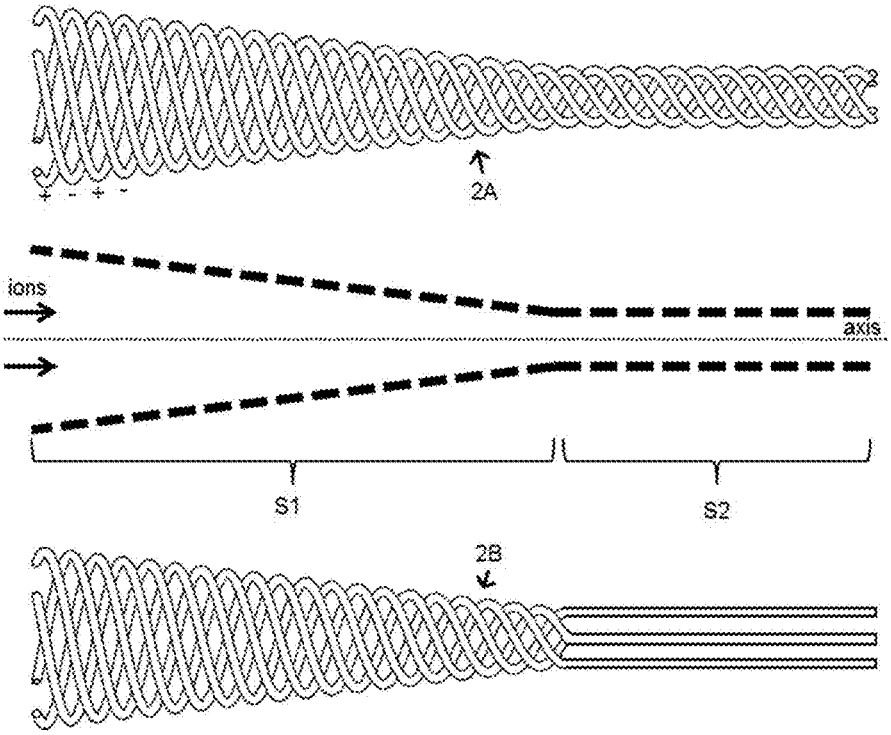
FIG. 7 presents several views of exemplary embodiments of an ion guide to be used in a mass spectrometer according to principles of the invention.

FIG. 7 shows schematically a first embodiment according to principles of the invention. Depicted is an RF ion guide 2A/2B being divided into two adjacent sections S1, S2, wherein a first section S1 comprises a tapering internal volume whereas a second adjacent section S2 has a cylindrical internal volume with constant radial diameter, see dashed contour at the center. The RF ion guide 2A/2B comprises four electrodes along its entire length in the example depicted, which can be supplied alternately with two phases of an RF voltage (0°-180°-0°-180° indicated by the sequence of "+" and "−" signs in the upper panel) in order to generate the radially confining potentials for the ions. In one variant, the four electrodes are helically wound around a central axis of the ion guide along its entire length, see upper embodiment 2A, whereas in a second implementation the helical configuration of the electrodes is realized merely in the first section while the helicity phases into a straight configuration in the adjacent second section, see lower embodiment 2B (one could say in mathematical terms: the pitch between adjacent windings increases from a given finite value in the first section to infinity in the second section). The electrodes in such second section S2 could also be bent, such as by 45° or 90°, instead of being straight while however being uncoiled.

In both cases illustrated, the four electrodes of the RF ion guide 2A/2B extend continuously from the first section S1 to the second section S2 and thereby do not leave any interruption in the RF confining fields in the internal volume when ions transit from the first section S1 to the second section S2. Moreover, due to the helical nature of the electrodes in at least the first section S1 of the RF ion guide 2A/2B, there do not appear any adverse pseudo-potential variations on the axis within the RF ion guide 2A/2B, thereby facilitating unhindered propagation of ions through the ion guide 2A/2B.

When viewed from the wider end of the first section S1 of the ion guide 2A/2B, the helical electrodes in FIG. 7 could be described to turn clockwise. It goes without saying, however, that the ion guiding effect or that of the RF confining fields is considered to not particularly depend on the sense of rotation. In other words, an implementation where the helical electrodes turn counter-clockwise should render the same result. One might surmise that the helicity of the electrodes could impart some concordant angular momentum to the ion beam, though no evidence for this could be found so far. Anyhow, it would be possible to switch the sense of rotation of the helical electrodes from clockwise to counter-clockwise, or vice versa, along the length of the ion guide, for example by introducing short intermediate straight electrode sections between the helical ones, if any particular technical effect were to be expected from such measure.

The electrodes in the embodiments of FIG. 7 are indicated to have a circular round cross section profile. But a skilled practitioner will understand that other cross section profiles, such as rectangular, square or flat strip-like, would be equally employable with implementations according to the principles of the present disclosure. Moreover, the lower panel of FIG. 7 illustrates a change in the degree of helicity from a finite value in the first section S1 to infinity in the second section S2. It would be likewise thinkable that the degree of helicity changes indeed but from a first finite value to another finite but different value. Such embodiments are considered to be comprised in the ambit of the disclosure.

Figure 8:
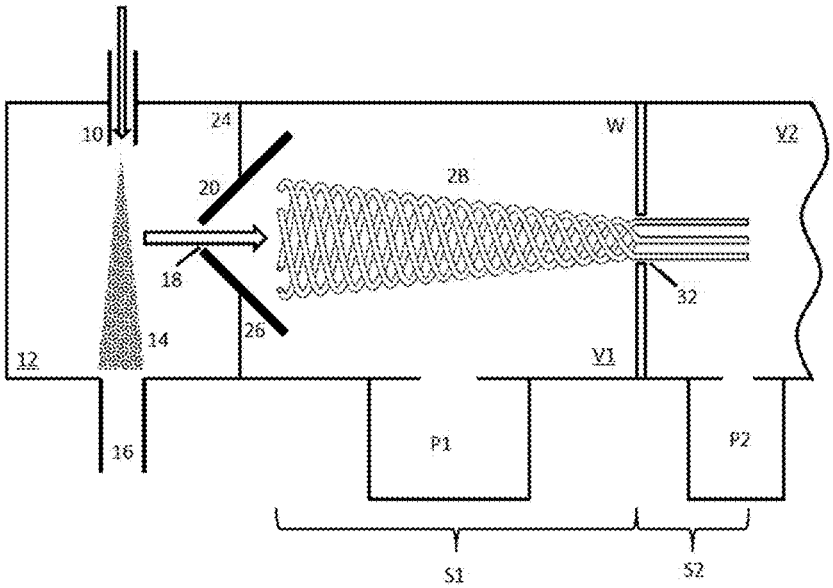
FIG. 8 illustrates an exemplary ion guide in the context of a mass spectrometric set-up according to principles of the invention.

FIG. 8 presents a schematic view of an interface arrangement in a mass spectrometer employing an ion guide 2B. In the example displayed, ions are formed at substantially atmospheric pressure by the electrospray process which is well known to a practitioner in the field. A spray probe 10 injects a sample liquid containing solvent and analytes of interest into a spray chamber 12 at substantially atmospheric pressure. Atmospheric pressure in the sense of the present disclosure is intended to mean a pressure of at least about $10^3$ Pascal, such as actual ambient pressure of the order of $10^5$ Pascal. The spray mist 14 containing mainly gas, (charged or uncharged) droplets and ions is propelled toward an exhaust port 16 through which parts of the spray mist 14 not sampled for the mass spectrometric analysis are vented to exhaust.

FIG. 8 shows a so-called perpendicular arrangement where the gas and ions are sampled in a direction substantially perpendicular to the direction of the spray ejection. This arrangement is however merely exemplary. It is equally possible to align the spray probe 10 in a different direction, for example, such that the spray direction substantially coincides with the axis of the entrance orifice 18 in the interface 20 (similar to the arrangement shown in FIG. 9 of U.S. Pat. No. 5,572,035 A to Jochen Franzen, for instance).

The ion source region 12 on the left-hand side of FIG. 8 is separated from an adjacent first vacuum stage V1 to the right by a divider wall 24, or similar boundary, which is complemented in the shown example by a conical centerpiece 26. The first vacuum stage V1 is pumped to a pressure preferably half of that in the ion source region (that is, less or substantially less than 55,000 Pascal, but not lower than 50 Pascal, for instance) by a vacuum pump P1 docked thereto. The interface cone 26 is made from a conductive material in order that an electric potential attracting the ions in the ion source region 12 can be applied thereto. The interface cone 26 may act as the counter-electrode to the spray probe 10 in the electrospray process, for instance. The apex of the cone 26 partly penetrates into the ion source region 12 and comprises a central opening 18 which forms a passageway for gas and ions from the ion source region 12 into the first vacuum stage V1. In this schematic view, a single central opening 18 is displayed for the sake of simplicity. It is to be understood, however, that a more complex aperture pattern could be provided in the cone 26, if expedient.

In the first vacuum stage V1 the wide end of a tapering ion guide section S1 is located opposite the wide end of the interface cone 26 from which gas and ions (and droplets as the case may be) emanate. The tapering ion guide section S1 may consist of four helically wound electrodes the winding diameter of which decreases along the central axis of the assembly (as shown), which are supplied alternately with the two opposite phases of an RF voltage to radially confine charged particles, such as ions. The neutral gas having passed the interface orifice 18 is not affected by the RF confinement, may flow through the interstitial gaps between the windings and is finally pumped off. Nonetheless, the pressure inside the first vacuum stage V1 is largely defined by the balance between gas flowing in through the orifice 18 from the ion source region 12, the gas pumped off, and a tiny amount of gas that manages to pass through a downstream opening 32 in another divider wall W at the other end of the first vacuum stage V1 into a second vacuum stage V2 held at a pressure lower than in the first vacuum stage V1 by means of vacuum pump P2.

This tiny amount of gas entering the second vacuum stage V2 may actually entrain the ions by a so called "ram-jet" effect if vacuum opening 32 is axially aligned with the direction of the initial jet expansion from central opening 18 or by viscous or molecular gas friction, that is, with large numbers of gentle collisions, and thereby represents a means of driving ions forward through the ion guide assembly 2B. If such gas-dynamical driving means is not sufficient or not available, such as by a non-linear propagation path through the mass spectrometer, the ion guide 2B may be operated with a DC voltage gradient along its length, brought about, for instance, by connecting different ends of the electrodes, which are made of, or at least comprise a moderately resistive material, to a DC voltage source (not shown).

The tapering ion guide section S1 transitions into a second ion guide section S2 with substantially constant radial diameter in which the electrodes run straight in the example depicted, though they could equally maintain their previous helicity, as illustrated in the upper embodiment of FIG. 7, or continue with a different degree of helicity. Ions are transmitted through the ion guide 2B through the opening 32 in the divider wall W into the second vacuum stage V2 in which an ion processing device, such as a collision cell or a mass analyzer, may be situated (not illustrated). The pressure could be held at about 100 Pascal or less in the second vacuum stage V2 and will be generally adapted to the pressure regimes in the upstream stage V1 and the spray chamber 12. The continuous design of the electrodes of ion guide 2B facilitates barrier-less transmission of a well-collimated beam of ions from the first vacuum stage V1 into the second vacuum stage V2 where the ions can then be further processed.

The electrospray probe 10 has been shown and described in the context of FIG. 8 by way of example only and in a very schematic manner. Practitioners in the field will acknowledge that a wide variety of different embodiments of electrospray probes are at their disposal from which they may choose the most practicable. Implementations may include some that work with additional lateral flows of heated gas in order to increase the desolvation capacity of the liquid spray probe. Further, ion sources shall in any case not be limited to those that work with the electrospray principle. It is equally possible to deploy other means for ionizing a liquid sample. One example would be an atmospheric pressure chemical ionization (APCI) source that ionizes gaseous neutral molecules that have been nebulized from a liquid by means of charge transfer reactions with certain reagent ions, as a skilled practitioner well knows.

FIG. 9A shows again a schematic of an ion guide 2A/2B with two sections S1 and S2 reaching through a divider wall W between two vacuum stages V1 and V2. On the low pressure side of the wall W, the straight section S2 runs through a separate substantially gastight casing 90 which has basically three openings. Two for receiving a part of the straight section S2 and one on an upper side through which a working gas, such as a collision gas like He, Ar or $N_2$, is supplied to the inner space of the casing 90 and establishes an elevated pressure therein in relation to its surroundings. While passing this casing 90, the ions can be collisionally focused on the axis of the assembly, can be fragmented into daughter ions if the axial kinetic energy is large enough for that purpose, or can also be made to react with a reactive working gas, such as methane $CH_4$, supplied thereto instead of (or in addition to) the inert gases He, Ar and $N_2$. In so doing, the transmitted ions can be further processed before being subjected to mass analysis in a mass analyzer further down the axis (not shown).

Figure 9A:
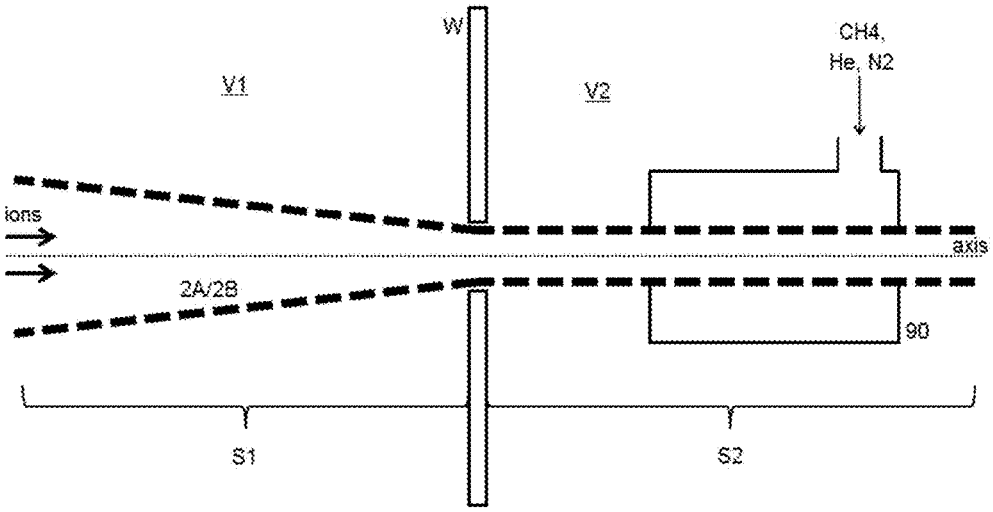
FIGS. 9A-B show variants of an ion guide in a mass spectrometer according to principles of the invention.
Figure 9B:
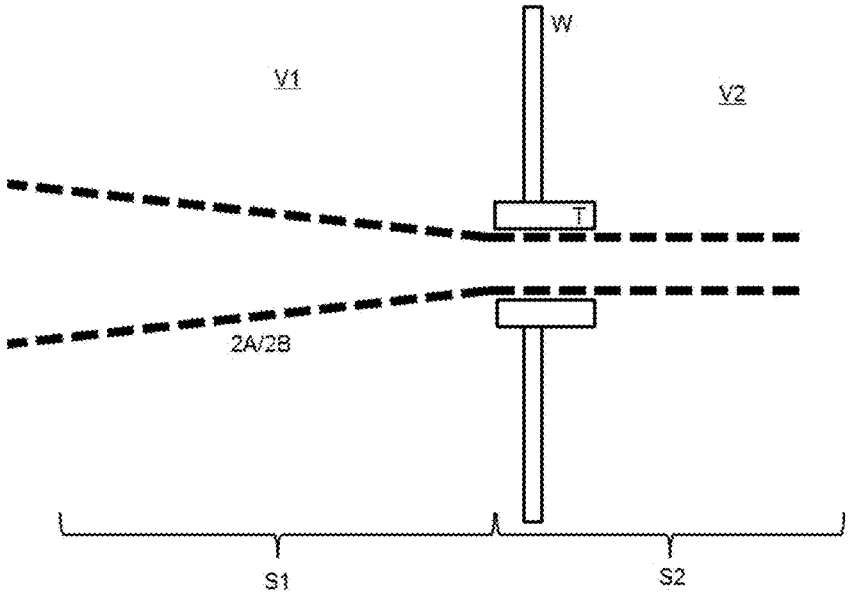

FIG. 9B illustrates a variant of the embodiment from FIG. 9A in that the passage through the divider wall W between the vacuum stages V1 and V2 does not merely consist of a hole or aperture but rather comprises a cylindrical, tubular body T that is mounted into such hole or aperture and through which the ion guide 2A/2B extends with its second section S2 in this case. Such cylindrical, tubular body T has the advantage of limiting the gas conductance from the upstream vacuum stage V1 to the downstream one V2 while at the same time not imposing any restrictions on the geometric acceptance for the ions which will see the same traversable aperture. The gas load on the pump generating the vacuum in the second stage V2 can thereby be reduced.

Figure 10:
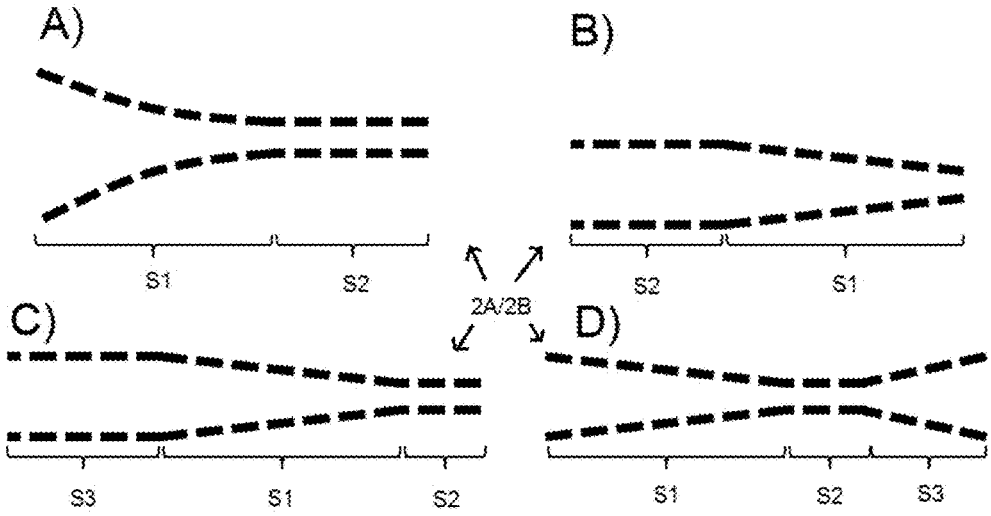
FIG. 10 depicts different variations of ion guide assemblies according to principles of the invention labeled, respectively, "A", "B", "C" and "D".

FIGS. 10A to 10D present variations in the configuration of the ion guide 2A/2B, each including the continuous extension of the electrodes along the entire length of the ion guide. In previous embodiments, the ion guide section S1 having variable radial diameter has been shown to comprise a linear taper. FIG. 10A presents an example where the internal volume tapers non-linearly, such that the outer dashed contour follows trumpet shape in the example depicted. Further, previous embodiments have shown the ion guide section S2 having substantially constant radial diameter to continue (or attach to) the narrow end of the first ion guide section S1 with variable radial diameter. FIG. 10B now illustrates a configuration where the second section S2 continues (or attaches to) the wider end of the first section S1. In such embodiment, the flow of ions may be from left to right or from right to left as shown in the figure, dependent on whether it is intended to collimate the ions into a comparatively fine ion beam (left to right) or to widen up the ion beam (right to left), for example, in preparation for a chemical modification using a reagent or in order to accommodate gas/ion expansion.

Furthermore, previous embodiments were depicted to comprise only two sections S1 and S2 of an ion guide 2A/2B. FIG. 10C and FIG. 10D expand on this by adding a third section S3 that may have a substantially constant radial diameter or a variable radial diameter as the specific application may require.

Figure 11:
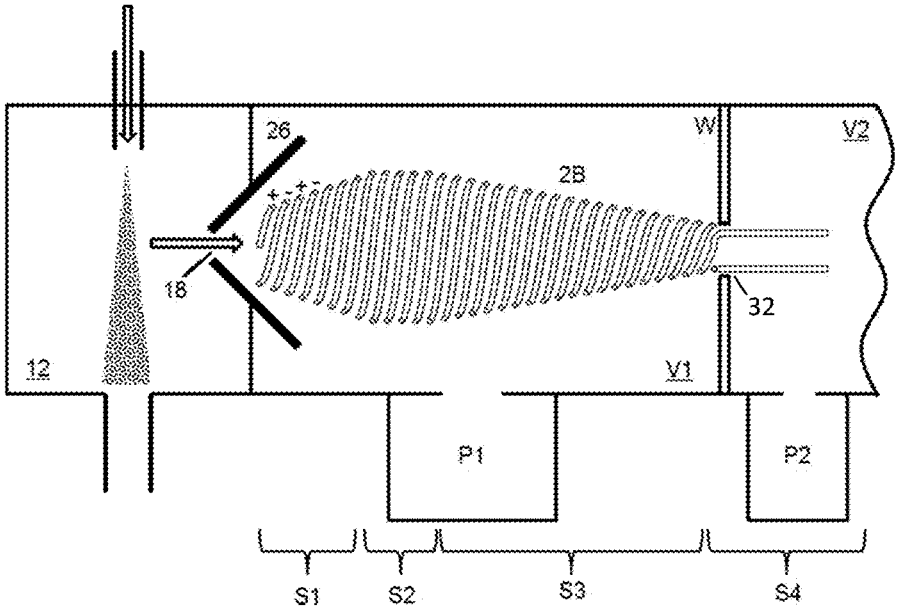
FIG. 11 shows a variant of the embodiment of FIG. 8 according to principles of the invention.

FIG. 11 now presents a variant of the embodiment presented in FIG. 8 in a slightly different illustration. As many parts and elements of this variant have the same function or effect as those in the previous embodiment, the following discussion will focus on the differences there-between. Instead of comprising two sections S1 and S2 as in FIG. 8, the quadrupolar RF ion guide 2B of the present implementation includes four different sections S1 to S4 of which two, S1 and S3, have a variable radial diameter whereas the other two, S2 and S4, have substantially constant radial diameter. Three of the four sections, S1, S2 and S3, comprise a configuration of helically wound and intertwined electrodes while the electrode shape in the last section S4 phases into a substantially straight (or rod-like) one. The electrodes of all four sections S1 to S4 are connected electrically to one another continuously, either as one-piece or respectively attached to one another. The present illustration of the electrodes differs from that of FIG. 8 insofar as it shows a section through the central axis providing a view on the half windings in sections S1, S2 and S3. In the last straight electrode section S4, the two electrodes in the foreground (from a total of four) are behind the viewpoint of the observer and therefore not visible.

The narrow end of the first section S1 faces the central opening 18 in the cone 26 and is ready to receive the flow of gas and entrained ions (as well as droplets as the case may be) that results from the pressure differential between spray chamber 12 and adjacent vacuum stage V1 for uncharged particles as well as incoming charged particles as a result of the voltage differential between sprayer and cone 26. As the transmitted fluid enters into a lower pressure regime in the vacuum stage V1 as compared to the spray chamber 12, it will undergo expansion. The first section S1 of the ion guide 2B with its flaring configuration is well suited to accommodate the expanding flow of fluid. The RF voltages applied to the adjacent electrode windings in opposite phases, as indicated by way of example by the "+" and "−" signs, ensures that the ions will be radially confined as they move forward, whereas the neutrals may escape the ion guide 2B through the gaps between the windings and be pumped off by pump P1.

Further down the ion guide 2B, in sections S2 and S3, the divergent (yet radially confined) flow of ions will be actually converged again by the narrowing or tapering of the radial diameter in the direction of propagation as evident from the outer electrode contour in section S3. This funneling section S3 facilitates the radial focusing of the ions toward the axis so that they can be transmitted in a slender, well-collimated beam into the final section S4 of the ion guide, passing the divider wall W through the opening 32 in so doing. The continuous nature of the electrodes being connected to the same RF voltage supply over the entire axial length of the ion guide 2B results in an axial potential within the ion guide 2B that is free of any variations or perturbations, thereby allowing the smooth axial transmission of ions without any loss from one section to the other, even transcending a vacuum stage wall W.

The sections S2 and S4 of the ion guide 2B in FIG. 11 having substantially constant radial diameter have been shown as comprising a configuration of helically wound electrodes and straight electrodes, respectively. It will appreciated by one of skill in the art, however, that other configurations could also be chosen without departing from the scope of the present disclosure. For example, section S2 could be realized with a substantially straight electrode configuration while section S4 could feature a helical one, or both sections S2 and S4 could have the same electrode configuration of being either helical or straight. Furthermore, the pitch of the windings of the helical electrodes is presented in FIG. 11 to be rather constant over the length of the ion guide 2B. Also this feature is shown merely by way of example and may be subject to modification, such as changing the degree of helicity from section to section, as a skilled practitioner sees fit. It will also be appreciated that the second section S2 having substantially constant radial diameter shown in the embodiment of FIG. 11 would not be strictly necessary (though may prove useful to further accommodate the fluid expansion) and could in some cases be dispensed with so that the first widening section S1 could directly phase into the third tapering section S3, thereby allowing a more compact design of the ion guide 2B as well as of the vacuum stage V1. Ion guide sections comprising an uncoiled electrode configuration could generally also comprise a bend, such as by 60° or 90°, in order to render a non-linear ion path in the ion guide 2B.

Figure 12:
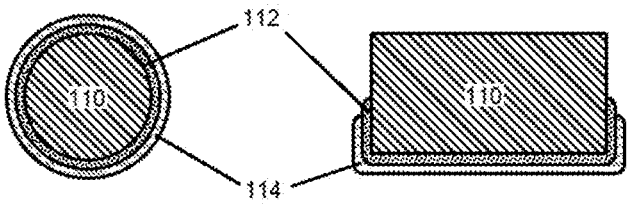
FIG. 12 presents exemplary cross section profiles of electrodes that can be used in an ion guide according to principles of the invention.

FIG. 12 shows schematically the cross section through embodiments of slightly enhanced electrodes, of circular round (left) and rectangular (right) profile in these examples though other cross section profiles are considered to be comprised within the ambit of this disclosure. Apart from the conductive core 110 that is foreseen to carry the RF voltage, it additionally comprises an insulator layer 112, such as made of glass, on which a resistive metal coating 114 has been applied. In the right embodiment, the coatings do not cover the whole circumference of the cross section profile but merely that side that will face the interior of the ion guide 2A/2B. Contacting the resistive coating 114 at two points along the length of the electrode in the RF ion guide 2A/2B establishes a voltage drop or rise there-between that can be used to drive the ions through the ion guide, dependent on the polarity. While one electrode thusly treated may be sufficient, it may be expedient to endow all electrodes in the ion guide 2A/2B with such coating for symmetry considerations.

The invention has been shown and described above with reference to a number of different embodiments thereof. It will be understood, however, by a person skilled in the art that various aspects or details of the invention may be changed, or various aspects or details of different embodiments may be arbitrarily combined, if practicable, without departing from the scope of the invention. Generally, the foregoing description is for the purpose of illustration only, and not for the purpose of limiting the invention which is defined solely by the appended claims, including any equivalent implementations, as the case may be.

The invention claimed is:

1. A mass spectrometer, comprising an ion guide having a plurality of electrodes that are supplied with a radio frequency voltage to facilitate radial confinement of ions in an internal volume defined by inward facing surfaces of the electrodes, the internal volume including a first section having a variable radial diameter along a longitudinal axis of the ion guide, in which the electrodes are helically wound, and an adjacent second section having a substantially constant radial diameter along the longitudinal axis, wherein the electrodes extend from the first section to the second section continuously, the mass spectrometer further comprising first and second vacuum stages separated by a divider wall and held at different pressures, wherein the first and second sections are located substantially in the first and second vacuum stages, respectively, while the electrodes extend continuously through an opening in the divider wall.

2. The mass spectrometer of claim 1, wherein the electrodes are helically wound in the second section of the internal volume.

3. The mass spectrometer of claim 1, wherein the internal volume tapers linearly in the first section of the ion guide.

4. The mass spectrometer of claim 1, wherein the constant radial diameter corresponds to one of a (i) largest and (ii) smallest radial diameter in the first section.

5. The mass spectrometer of claim 1, wherein the internal volume further comprises a third section adjacent to the first or second section having one of a (i) substantially constant and (ii) variable radial diameter along the longitudinal axis, the electrodes extending continuously from the first or second section to the third section, respectively.

6. The mass spectrometer of claim 5, wherein the internal volume further comprises a fourth section adjacent to the first, second or third section having one of a (i) substantially constant and (ii) variable radial diameter along the longitudinal axis, the electrodes extending continuously from the first, second or third section to the fourth section, respectively.

7. The mass spectrometer of claim 1, further comprising a cylindrical, tubular member being mounted in the opening of the divider wall, wherein the electrodes extend through the cylindrical, tubular member from the first vacuum stage to the second vacuum stage.

8. The mass spectrometer of claim 1, wherein at least one of the plurality of electrodes comprises an insulator layer on which a resistive coating is deposited, the resistive coating being connected to a DC voltage source so as to establish a DC voltage gradient along the longitudinal axis that drives ions through the ion guide.

9. The mass spectrometer of claim 8, wherein the insulator layer and the resistive coating on the electrode(s) extend over one of (i) a portion and (ii) the entire longitudinal dimension of the ion guide.

10. The mass spectrometer of claim 1, further comprising means for establishing a gas flow through the ion guide so as to drive ions through the first and second sections.

11. The mass spectrometer of claim 1, wherein a number of electrodes in the ion guide is four, six, eight or more and the radio frequency voltage comprises two phases (0°, 180°) that are applied alternately to adjacent electrodes.

12. The mass spectrometer of claim 1, wherein a number of electrodes in the ion guide is three and the radio frequency voltage comprises three phases (0°, 120°, 240°) that are applied alternately to adjacent electrodes.

13. The mass spectrometer of claim 1, further comprising mounting rings to which the electrodes are attached in order to maintain their alignment and positioning.

14. The mass spectrometer of claim 1, wherein the electrodes take the shape of flat strips a large surface side of which faces the internal volume of the ion guide.

15. The mass spectrometer of claim 1, wherein the electrodes comprise at least one of copper, beryllium copper, phospor bronze, stainless steel, Inconel™, Elgiloy™, and Hastelloy™.

16. The mass spectrometer of claim 1, being a triple quadrupole mass spectrometer.

17. A mass spectrometer, comprising an ion guide having a plurality of electrodes that are supplied with a radio frequency voltage to facilitate radial confinement of ions in an internal volume defined by inward facing surfaces of the electrodes, the internal volume including a first section having a variable radial diameter along a longitudinal axis of the ion guide, in which the electrodes are helically wound, and an adjacent second section having a substantially constant radial diameter along the longitudinal axis, wherein the electrodes extend from the first section to the second section continuously, wherein the electrodes are substantially straight in the second section of the internal volume.

18. A mass spectrometer, comprising an ion guide having a plurality of electrodes that are supplied with a radio frequency voltage to facilitate radial confinement of ions in an internal volume defined by inward facing surfaces of the electrodes, the internal volume including a first section having a variable radial diameter along a longitudinal axis of the ion guide, in which the electrodes are helically wound, and an adjacent second section having a substantially constant radial diameter along the longitudinal axis, wherein the electrodes extend from the first section to the second section continuously, wherein the internal volume tapers nonlinearly in the first section of the ion guide.

19. A mass spectrometer, comprising an ion guide having a plurality of electrodes that are supplied with a radio frequency voltage to facilitate radial confinement of ions in an internal volume defined by inward facing surfaces of the electrodes, the internal volume including a first section having a variable radial diameter along a longitudinal axis of the ion guide, in which the electrodes are helically wound, and an adjacent second section having a substantially constant radial diameter along the longitudinal axis, wherein the electrodes extend from the first section to the second section continuously, wherein the electrodes are non-helical and curved in the second section of the internal volume.

20. A mass spectrometer, comprising an ion guide having a plurality of electrodes that are supplied with a radio frequency voltage to facilitate radial confinement of ions in an internal volume defined by inward facing surfaces of the electrodes, the internal volume including a first section having a variable radial diameter along a longitudinal axis of the ion guide, in which the electrodes are helically wound, and an adjacent second section having a substantially constant radial diameter along the longitudinal axis, wherein the electrodes extend from the first section to the second section continuously, wherein a portion of the second section extends through a casing in which an elevated pressure is maintained so as to function as a collision cell.

* * * * *